US006851262B1

(12) United States Patent
Gregory et al.

(10) Patent No.: US 6,851,262 B1
(45) Date of Patent: Feb. 8, 2005

(54) TOOLS FOR SECURING CONNECTORS USING EXPLOSIVE CHARGES AND METHODS FOR USING THE SAME

(75) Inventors: Owen Gregory, Apex, NC (US); Willie Hernandez, Markham (CA)

(73) Assignee: Tyco Electronics, Corporation, Middletown, PA (US)

( * ) Notice: Subject to any disclaimer, the term of this patent is extended or adjusted under 35 U.S.C. 154(b) by 0 days.

(21) Appl. No.: 10/633,397

(22) Filed: Aug. 1, 2003

(51) Int. Cl.[7] ..... F01B 29/08
(52) U.S. Cl. ..... 60/632; 60/636; 60/638
(58) Field of Search ..... 60/632, 636, 638

(56) References Cited

U.S. PATENT DOCUMENTS

| | | | | |
|---|---|---|---|---|
| 3,296,792 A | * | 1/1967 | Hedberg et al. | 60/632 |
| 3,345,454 A | | 10/1967 | Mixon | 174/84 |
| 3,681,512 A | | 8/1972 | Werner et al. | 174/84 R |
| 3,742,582 A | | 7/1973 | Broske | 29/421 |
| 3,761,602 A | | 9/1973 | De Sio et al. | 174/73 SC |
| 3,826,860 A | | 7/1974 | De Sio et al. | 174/73 S |
| 4,252,992 A | | 2/1981 | Cherry et al. | 174/90 |
| 4,722,189 A | | 2/1988 | Center | |
| 4,752,252 A | | 6/1988 | Cherry et al. | 439/784 |
| RE33,098 E | | 10/1989 | Center | |
| 4,905,603 A | | 3/1990 | McBain | |
| 4,945,730 A | | 8/1990 | Laney | |
| 5,239,829 A | | 8/1993 | Blake | |
| 5,337,566 A | * | 8/1994 | Lomastro et al. | 60/632 |
| 5,600,096 A | | 2/1997 | Cherry et al. | 174/84 R |
| 5,683,273 A | | 11/1997 | Garver et al. | 439/784 |

OTHER PUBLICATIONS

Declaration of Byron L. Royse under 37 C.F.R. § 1.132, including Appendices A and B, dated Sep. 30, 2002.

International Search Report for PCT/US02/25559, mailed Apr. 2, 2003.

U.S. Appl. No. 10/217,134, titled *Connector and Method for Forming a Connection with an Electrical Cable*, inventors Johnson et al., filed on Aug. 12, 2002.

Customer Manual, *AMPACT Taps, Stirrups, and Application Tooling*, 409–2106, Rev M, Feb. 5, 1999, 39 pages.

AMP Customer Manual, *AMPACT Taps, Stirrups and Application Tooling*, #409–2106, Feb. 5, 1999 Rev. M.

* cited by examiner

*Primary Examiner*—Hoang Nguyen
(74) *Attorney, Agent, or Firm*—Myers Bigel Sibley & Sajovec, P.A.

(57) ABSTRACT

A tool for securing a connector on a conductor using an explosive charge includes a first tool member and a second tool member movably mounted on the first tool member. A breech chamber is defined in at least one of the first and second tool members. The breech chamber is adapted to receive the explosive charge. A breech opening is defined in at least one of the first and second tool members and communicates with the breech chamber. A drive member is provided. The tool is adapted to forcibly move the drive member responsive to an explosion of the explosive charge in the breech chamber. The second tool member is movable between a closed position, wherein the breech opening is closed, and an open position, wherein the breech opening is open to allow loading and unloading of the explosive charge into and from the breech chamber, by sliding the second tool member relative to the first tool member along a slide axis and additionally pivoting the second tool member relative to the first tool member about a pivot axis transverse to the slide axis.

43 Claims, 12 Drawing Sheets

TOOLS FOR SECURING CONNECTORS USING EXPLOSIVE CHARGES AND METHODS FOR USING THE SAME

FIELD OF THE INVENTION

The present invention relates to tools and methods for using tools and, more particularly, to tools and methods for securing or terminating connectors.

BACKGROUND OF THE INVENTION

Electrical cables often must be terminated or joined (spliced) in various environments, such as underground or overhead. Such cables may be, for example, high voltage electrical distribution or transmission lines. In order to form such connections, a connector may be employed. To install such connectors, it may be necessary to force two members into engagement, typically such that one or both of the members are deformed. Exemplary connectors include a C-shaped sleeve and wedge combination as disclosed in U.S. Pat. No. 4,722,189 to Center. In order to install such connectors, it is typically necessary to apply a relatively great force between the wedge and the sleeve. However, the amount of force should not be excessive as this may compromise the formation or integrity of the connection. Because the connections are often formed in dangerous locations (e.g., high above the ground) and with high voltage lines, it is desirable to provide the necessary force in a manner that is convenient and safe under such circumstances.

To provide the application force as discussed above, explosive charge-actuated tools (sometimes referred to as "powder-actuated tools") are commonly used. According to some designs, explosive charge-actuated tools include a tool body, a tool head secured to the tool body, and a ram slidably mounted in the tool body. In use, the connector components are placed between the ram and the tool head. An explosive charge, typically provided in a cartridge, is exploded in the tool body such that the ram is forced against the connector to thereby force the connector components into secure engagement. The explosion of the charge may generate pressurized gas in the tool body. If not first controllably released, the pressurized gas may harm the user when the user attempts to open the tool body to remove the expended explosive charge cartridge. Thus, tools of this type may provide a mechanism for pre-releasing pressurized gas from the tool body, for example, from a breech chamber that holds the cartridge. Exemplary tools of this type include the AMPACT tool available from Tyco Electronics, Inc. and the tools disclosed in U.S. Pat. No. 4,722,189 to Center and in U.S. Pat. No. 4,905,603 to McBain. However, such tools may be difficult to operate under some circumstances or may require substantial and frequent maintenance to ensure safe and effective operation.

SUMMARY OF THE INVENTION

According to embodiments of the present invention, a tool for securing a connector on a conductor using an explosive charge includes a first tool member and a second tool member movably mounted on the first tool member. A breech chamber is defined in at least one of the first and second tool members. The breech chamber is adapted to receive the explosive charge. A breech opening is defined in at least one of the first and second tool members and communicates with the breech chamber. A drive member is provided. The tool is adapted to forcibly move the drive member responsive to an explosion of the explosive charge in the breech chamber. The second tool member is movable between a closed position, wherein the breech opening is closed, and an open position, wherein the breech opening is open to allow loading and unloading of the explosive charge into and from the breech chamber, by sliding the second tool member relative to the first tool member along a slide axis and additionally pivoting the second tool member relative to the first tool member about a pivot axis transverse to the slide axis.

According to method embodiments of the present invention, a method for using a tool for securing a connector on a conductor using an explosive charge is provided. The tool includes: a first tool member, a second tool member movably mounted on the first tool member; a breech chamber defined in at least one of the first and second tool members, the breech chamber being adapted to receive the explosive charge; a breech opening defined in at least one of the first and second tool members, the breech opening communicating with the breech chamber; and a drive member. The tool is adapted to forcibly move the drive member responsive to an explosion of the explosive charge in the breech chamber. The method includes sliding the second tool member relative to the first tool member along a slide axis. The second tool member is pivoted relative to the first tool member about a pivot axis transverse to the slide axis such that the second tool member is moved from a closed position, wherein the breech opening is closed, to an open position, wherein the breech opening is open to allow loading and unloading of the explosive charge into and from the breech chamber.

Objects of the present invention will be appreciated by those of ordinary skill in the art from a reading of the figures and the detailed description of the preferred embodiments which follow, such description being merely illustrative of the present invention.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
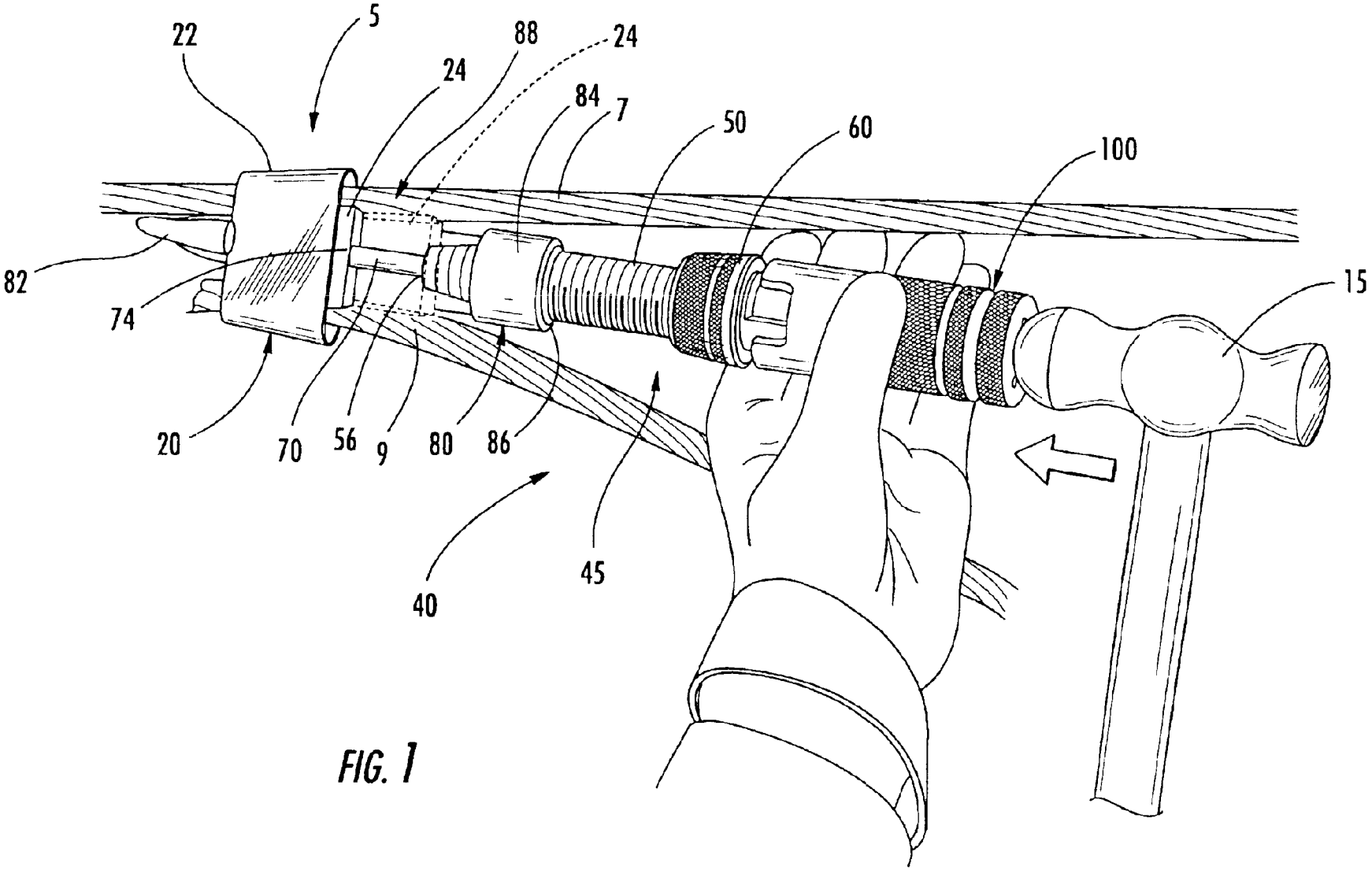
FIG. 1 is a perspective view illustrating the formation of a connection using a tool assembly and methods according to embodiments of the present invention.

With reference to FIG. 1, a tool assembly 40 according to embodiments of the present invention is shown therein. The tool assembly 40 may be used to form a connection 5 as shown in FIG. 1, for example. The connection 5 includes a pair of conductors 7, 9 securely and electrically coupled by a connector 20. The connector 20 includes a C-shaped sleeve 22 and a wedge 24. Connectors of this type are well-known to those of skill in the art and will not be described in further detail herein except as needed to describe embodiments of the present invention. Generally, and as described in more detail below, the tool assembly 40 may be used to force or impel the wedge 24 and the sleeve 22 into engagement using an explosive charge 32 (e.g., as provided in a cartridge 30; see FIG. 11).

Figure 6:
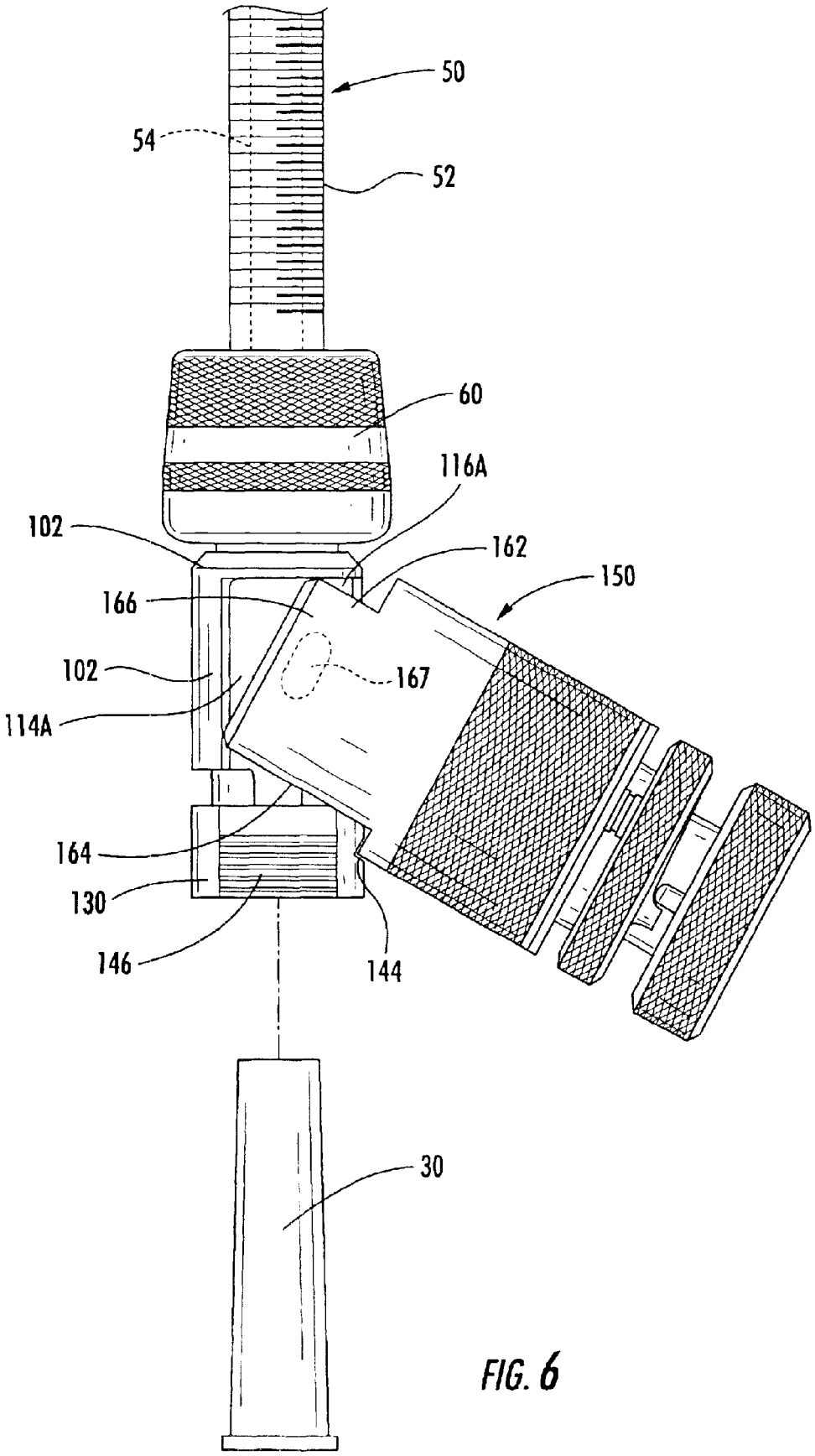
FIG. 6 is a side elevational view of the tool assembly of FIG. 1 and a cartridge for use therewith, wherein the drive assembly is in an open position.

With reference to FIG. 1, the tool assembly 40 includes an explosively actuated industrial tool 45 and an anvil or tool head 80. The tool 45 includes a barrel or coupling 50, a coupling nut 60, a drive assembly 100 joined to the coupling 50 by the coupling nut 60, and a ram 70 slidably mounted in the coupling 50. With reference to FIG. 6, the drive assembly 100 includes a breech 102, an ejector sleeve 130, and a breech cap assembly 150. Each of these components will be described in more detail below. The coupling 50, the coupling nut 60 and the ram 70 are omitted from FIGS. 11 and 12 for clarity.

The coupling 50 includes threads 52 (FIG. 10) on its outer surface. A bore or barrel passage 54 extends through the coupling 50 and communicates with opposed end openings 56 (FIGS. 1 and 10).

The breech 102 has opposed front and rear ends 104A and 104B. A breech chamber 106 (FIG. 11) is defined in the breech 102, which is generally tubular. The breech chamber 106 communicates with a front breech opening 108A (FIG. 3) and a rear breech opening 108B (FIG. 4). A coupling thread 110 (FIG. 5A) is formed on the outer surface of the breech 102 on the front end 104A thereof. A radially extending coupling set screw bore 112 (FIG. 3) is also formed on the front end 104A for securing the breech 102 to the coupling nut 60. A pair of opposed, axially extending guide channels 114A, 114B (FIGS. 5A and 5B) are defined in the outer surface of the breech 102 on opposed sides thereof. A pair of circumferentially extending guide channels 116A and 116B (FIGS. 5A and 5B) are also defined in the outer surface of the breech 102 on opposed sides thereof and intersect the axially extending channels 114A and 114B, respectively, adjacent the front end 104A. A pair of opposed, radially extending screw holes 118 (FIG. 4) are formed in the rear end 104B. A recessed end portion 120 and an end flange 122 are also provided on the rear end 104B (FIG. 4).

The ejector sleeve 130 is mounted on the recessed end portion 120. The ejector sleeve defines a front opening 134A (FIG. 3), a rear opening 134B (FIG. 4) and a bore 132 (FIG. 3) communicating with each of the openings 134A, 134B. The rear opening 134B is defined by a radially inwardly extending, circumferential flange 136 (FIG. 4). The bore 132 receives the recessed end portion 120 such that the flange 136 surrounds the end flange 122. Opposed guide screws 140 (FIGS. 3 and 10) extend from the screw holes 118 in the recessed end portion 120 and are slidably received in opposed axially extending slots 138 (FIG. 3) defined in the ejector sleeve 130. Grip ribs 146 (FIG. 6) are provided on opposed sides of the ejector sleeve 130. The ejector sleeve 130 further includes a lock pin recess 142 and a support recess 144 (FIG. 4).

Figure 10:
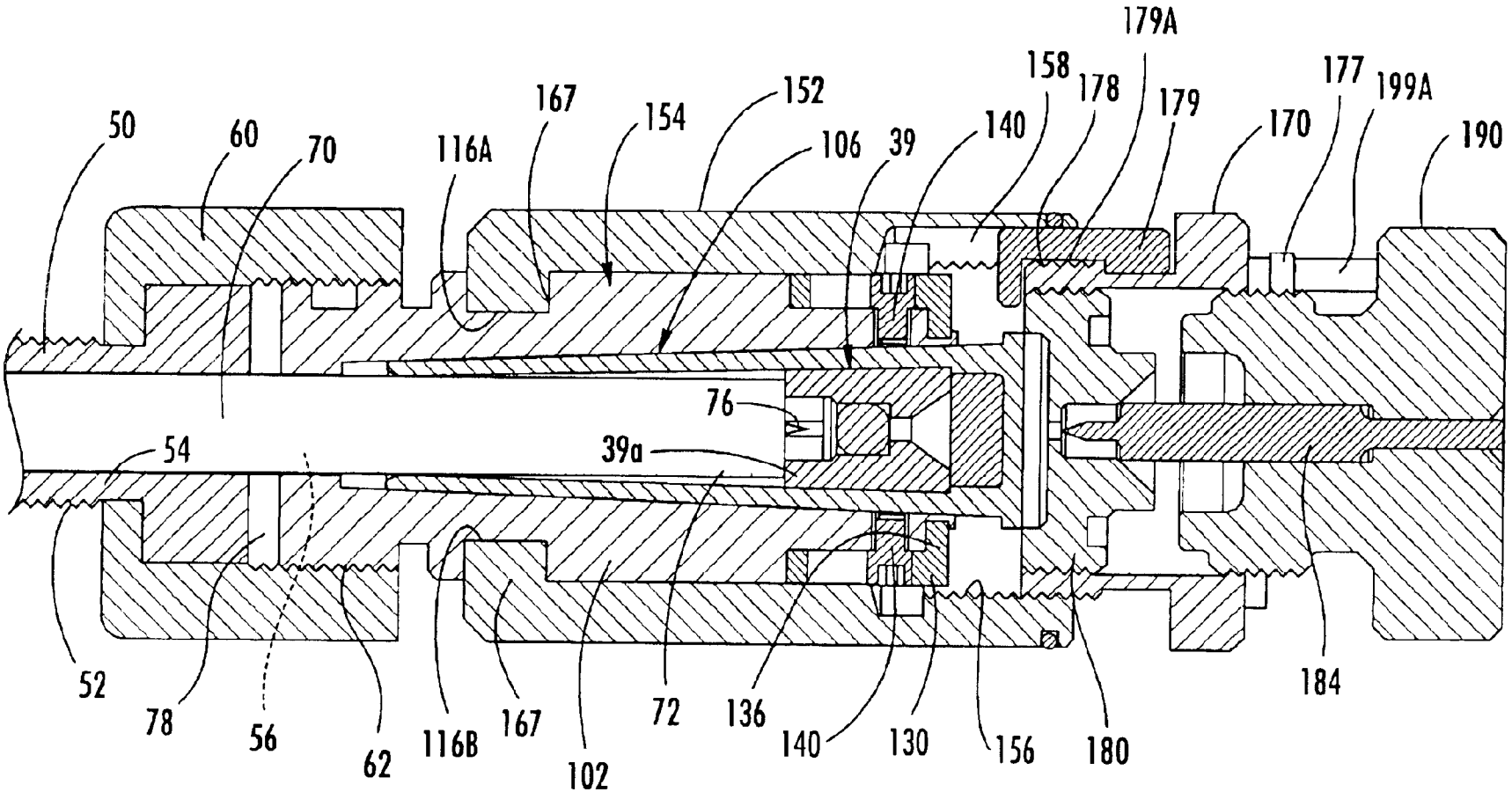
FIG. 10 is a cross-sectional view of the drive assembly of FIG. 2.

The coupling nut 60 includes a threaded bore 62 (FIG. 10). The threaded bore 62 is configured to threadedly engage the coupling threads 110 of the breech 102. The coupling nut 60 serves to secure the coupling 50 to the drive assembly 100. The coupling 50 is slidable in the coupling nut 60 so as to allow a small gap 78 (see FIG. 10).

The ram 70 is a generally cylindrical rod having a strike end 72 (FIG. 10) and an opposed driven end 74 (FIG. 1). A firing pin 76 (FIG. 10) projects from the driven end. The ram 70 is slidable in the coupling 50 and the breech 102.

The breech cap assembly 150 includes a breech cap sleeve 152, a pin guide housing 170, a pin guide 180, a retaining spring 181, a gas release member or knob 190, a piercer pin 184, a stop screw 199, and a lock pin 179. The breech cap assembly 150 is movable between a closed position (FIGS. 2 and 12) and an open position (FIG. 6) as described in more detail below.

The breech cap sleeve 152 is generally tubular and defines an axially extending passage 154 that, in the closed position, surrounds the breech 102 and the ejector 130. A front opening 154A (FIG. 3) and a rear opening 154B (FIG. 4) communicate with the passage 154 on either end. Internal threads 156 (FIG. 4) are formed adjacent the rear opening 154B. A lock pin guide slot 158 extends axially through the threads 156. Knurling may be formed on the outer surface of the breech cap sleeve 152 to facilitate gripping. Opposed slots 162, 164 (FIG. 3) are defined in the breech cap sleeve 152 adjacent and in communication with the front opening 154A. The slot 164 is longer than the slot 162. The slots 162, 164 define opposed, axially extending arms 166. Opposed guide projections or tabs 167 extend radially inwardly from respective ones of the arms 166 and into respective ones of the channels 116A, 116B when the breech cap assembly 150 is in the closed position. An end groove 168 formed in the breech cap sleeve 152 adjacent the rear end 154B and is adapted to receive the retaining spring 181.

Figure 3:
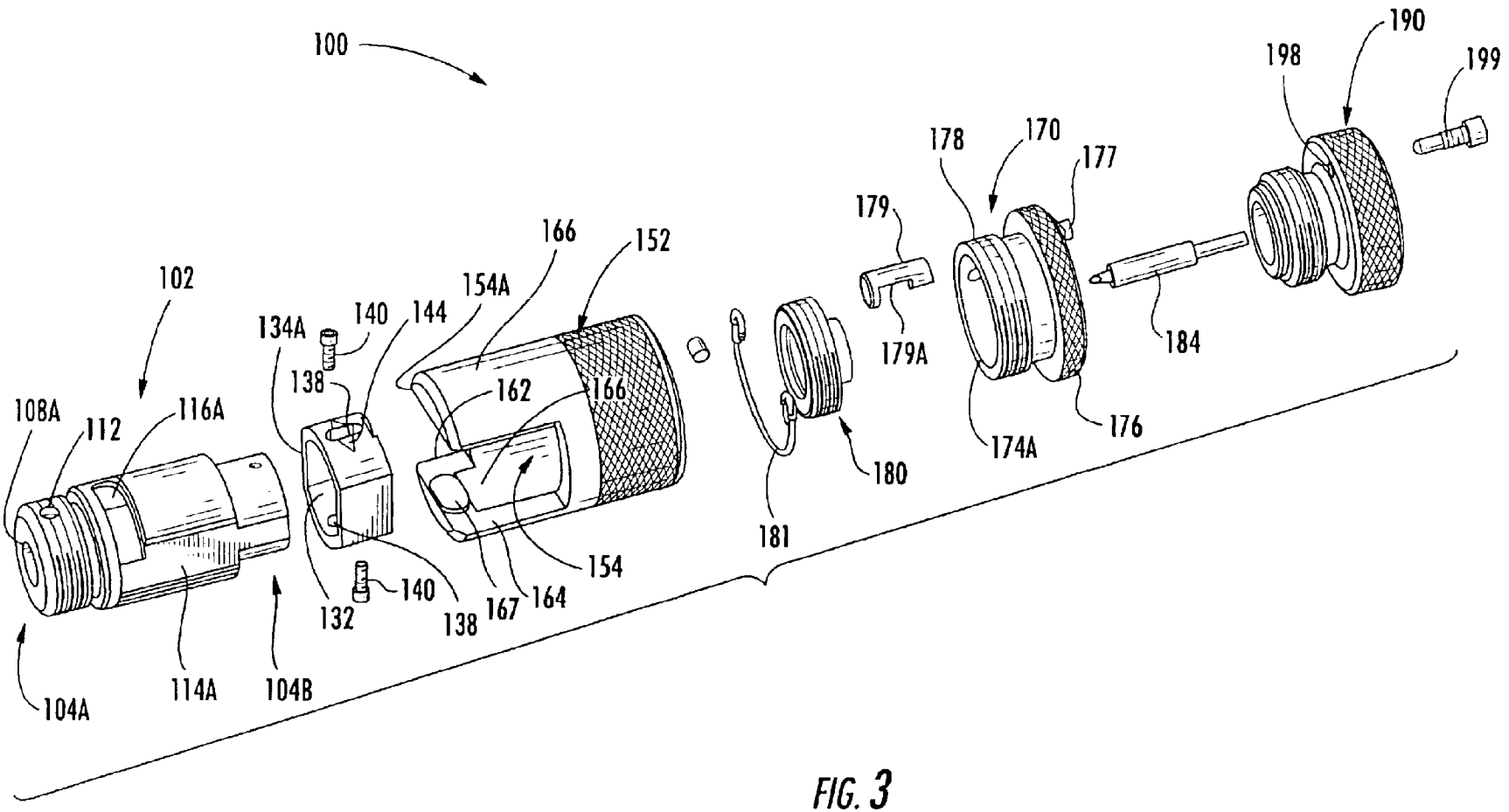
FIG. 3 is a front, perspective, exploded view of the drive assembly of FIG. 2.
Figure 4:
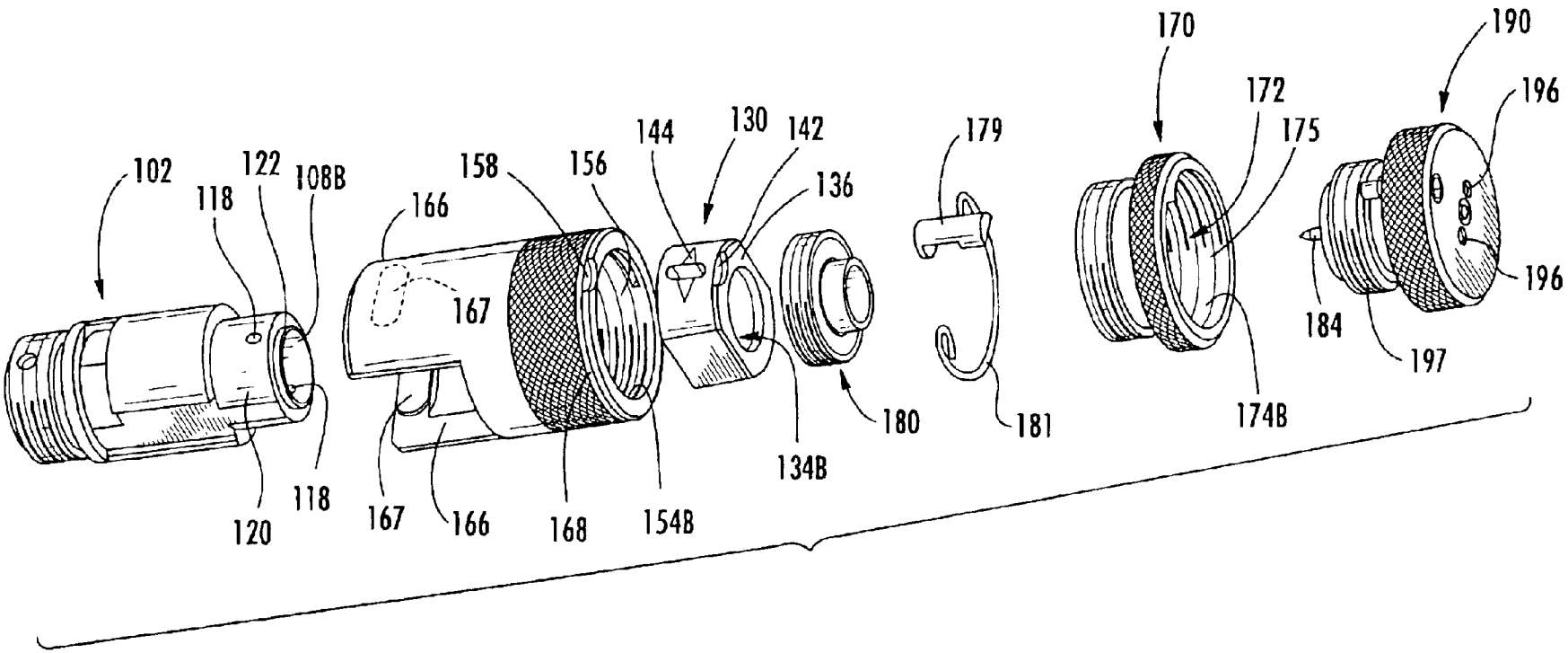
FIG. 4 is a rear, perspective, exploded view of the drive assembly of FIG. 2.
Figure 5A:
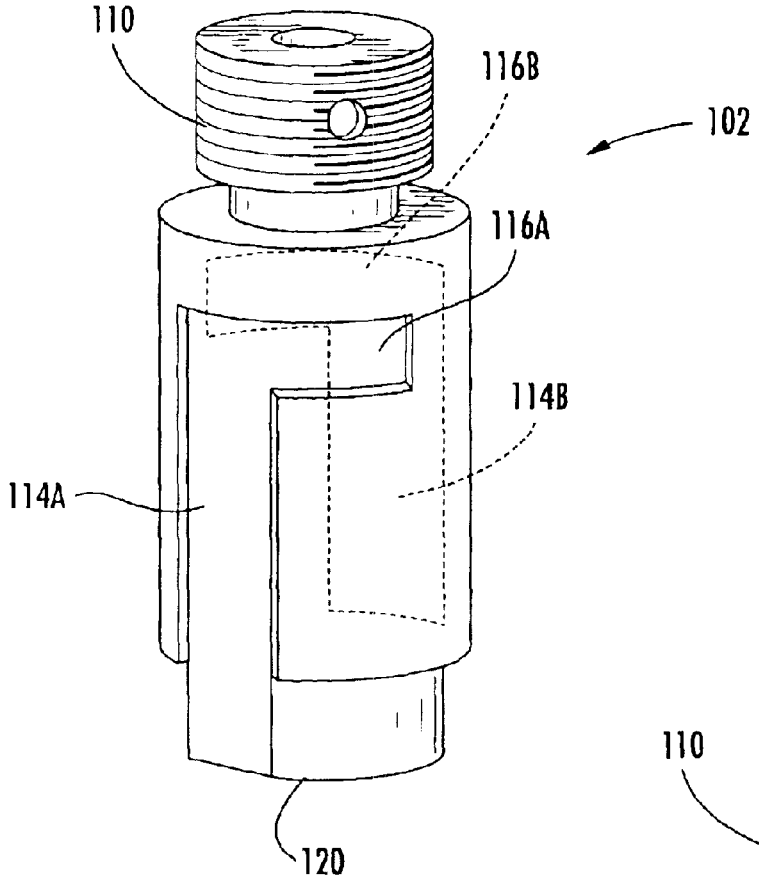
FIGS. 5A and 5B are perspective views of a breech forming a part of the drive assembly of FIG. 2 as viewed from opposed sides thereof.
Figure 5B:
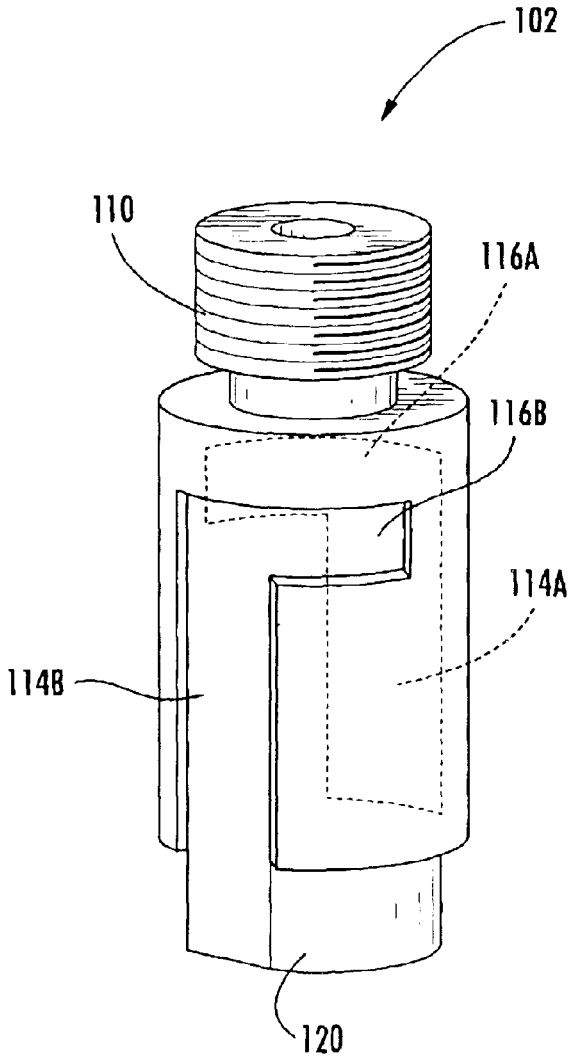

With reference to FIGS. 3 and 4, the pin guide housing 170 defines a front opening 174A, a rear opening 174B, and a bore 172 communicating with each of the openings 174A, 174B. Internal threads 175 are provided in the bore 172. A knurled flange 176 is provided for manipulating the pin guide housing 170. A tab 177 extends axially rearwardly from the flange 176. External threads 178 are formed adjacent the front opening 174A and are configured to mate with the threads 156 of the breech cap sleeve 152. Slots are formed in the groove 168 of the breech cap sleeve 152 to allow the retaining spring 181 to extend therethrough and engage the threads 178, thereby preventing full withdrawal of the pin guide housing 170 from the breech cap sleeve 152.

As best seen in FIGS. 3 and 10, the lock pin 179 is mounted on the threads 178 of the pin guide housing 170 such that the threads 178 are received in an intermediate cutout 179A of the lock pin. A front portion of the lock pin 179 is slidably received in the lock pin guide slot 158 of the breech cap sleeve 152 and, when the breech cap assembly 150 is in the closed position, into the lock pin recess 142 of the ejector sleeve 130. A rear portion of the lock pin 179 extends rearwardly from the breech cap sleeve 130 and abuts the flange 176 of the pin guide housing 170.

The pin guide 180 is disposed in the bore 172 of the pin guide housing 170. External threads on the outer surface of the pin guide 180 mate with the internal threads 175. An axially extending passage 182 (FIG. 12) is defined in the pin guide 180. The piercer pin 184 is slidably received in the passage 182. According to some embodiments, the pin guide 180 and the pin guide housing 170 may be unitarily formed.

The gas release knob 190 includes an end wall 191. A flange 193 (which may be knurled) surrounds the end wall 191 for manipulating the gas release knob 190. The piercer pin 184 is fixed within a pin bore 194 formed in the end wall 191. A pair of gas release passages 196 formed in the end wall 191 provide fluid communication between the breech chamber 106 and the environment. External threads 197 are formed on the front end of the gas release knob 190 and mate with the threads 178 of the pin guide housing 170. A threaded stop screw hole 198 extends axially through the flange 193. The stop screw 199 is mounted in the stop screw hole 198 with a portion 199A (FIG. 10) of the stop screw 199 extending axially forward from the flange 193 such that the portion 199A engages the tab 177 of the pin guide housing 170 upon rotation of the knob 190. That is, the portion 199A and the tab 177, or respective portions thereof, are located at the same positions along the axis S—S and the same radial distance from the axis S—S.

According to some embodiments, the piercer pin guide 184 and the gas release knob 190 may be unitarily formed. According to some embodiments, the pin guide housing 170 may be omitted. In this case, the piercer pin guide 180 may be secured to or formed as a part of the breech cap sleeve 152 and the lock pin 179 may be mounted directly on and operatively engaged by the threads 197 in a manner corresponding to that described above and illustrated for the pin guide housing 170.

Figure 11:
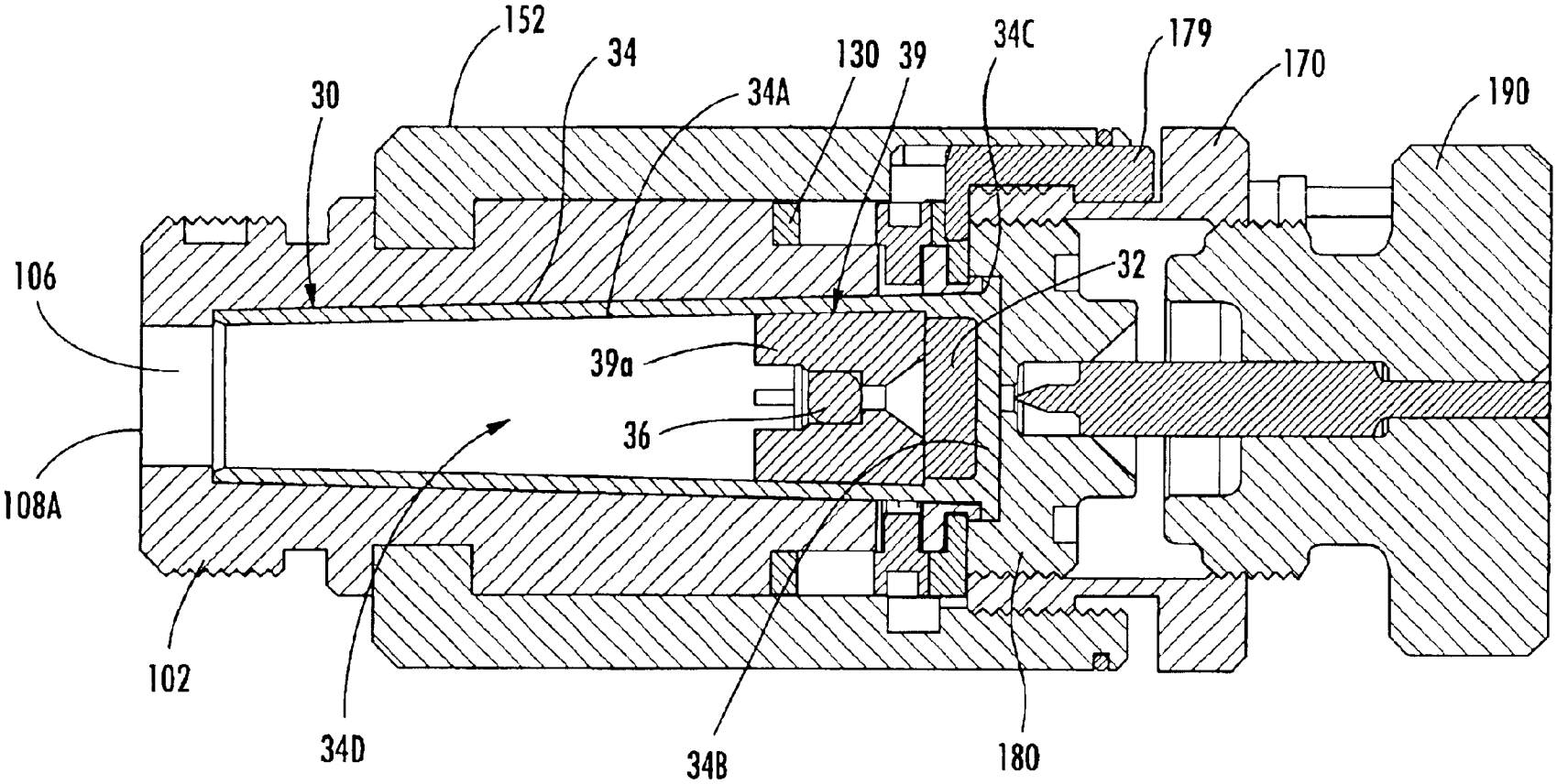
FIG. 11 is a cross-sectional view of the drive assembly of FIG. 2 taken along the same line as FIG. 10 and wherein the drive assembly is in a further position.

With reference to FIG. 11, the cartridge 30 may be a cartridge of any suitable design and construction. Suitable cartridges are available from Tyco Electronics, Inc. The cartridge 30 as illustrated includes a shell 34 having a side wall 34A, an end wall 34B, and a radially outwardly extending flange 34C, and defining a shell cavity 34D. A quantity of primer 36 and the main charge 32 are disposed in the shell cavity 34D. The primer 36 may be, for example, a quantity of nitroglycerin packaged in a cap or the like. The charge 32 may be, for example, a quantity of gun powder or other suitable propellant. The charge 32 is separated from the primer by a gas check 39. The gas check has upstanding prongs 39A. The cartridge may be formed of a polymeric material such as polyethylene, for example.

With reference to FIG. 1, the tool head 80 includes an abutment 82, a driver mount portion 84, and a cradle 88 defined therebetween. A threaded coupling bore 86 is formed in the driver mount portion 84. The tool head 80 is exemplary, and any suitable tool head may be employed.

The foregoing components may be formed of any suitable materials. According to some embodiments, with the exception of the cartridge 30, all of the components are preferably formed of metal and, more preferably, steel of appropriate strength and hardness.

The tool assembly 40 may be used to form the connection 5 in the following manner. For the purposes of explanation, the procedure will be described starting with an initially open configuration wherein no cartridge 30 is installed in the drive assembly 100 and the drive assembly is in the open position. It will be appreciated from the description herein that certain of the steps discussed below can be revised in order.

The connection 5 may be temporarily formed by installing the sleeve 22 on and about the conductors 7, 9, and forcing the wedge 24 into the sleeve 22 by hand or using a hammer.

When the drive assembly 100 is in the open position as shown in FIG. 6, the breech cap assembly 150 is located such that it does not cover the breech opening 108B. The pin guide housing 170 and the gas release knob 190 are each unscrewed or backed out to respective open positions as shown in FIG. 10. Accordingly, the piercer pin 184 is retracted with respect to the pin guide 180.

According to some embodiments, it is preferable to load the tool 45 with the tool vertically oriented such that the coupling points upwardly. In order to maintain the breech cap assembly 150 in the open position, an edge of the breech cap sleeve 152 may be inserted into the support recess 144 whereby the breech cap assembly 150 is supported. Such a configuration, which is shown in FIG. 6, allows the user to use one hand to hold the tool 45 and the other hand to hold the cartridge 30 while the breech cap assembly 150 remains properly positioned.

The cartridge 30 is inserted into the breech chamber 106 through the breech opening 108B. In doing so, the ram 70 is inserted into the forward portion of the shell cavity 38 such that the driven end 74 of the ram is positioned above the primer 36 but separated therefrom by the prongs 39A. According to some embodiments, the shell 34 is sized such that it will be temporarily retained in the opening 134B by a moderate friction fit. The shell 34 may include compressible ribs on its outer surface for this purpose.

Figure 7:
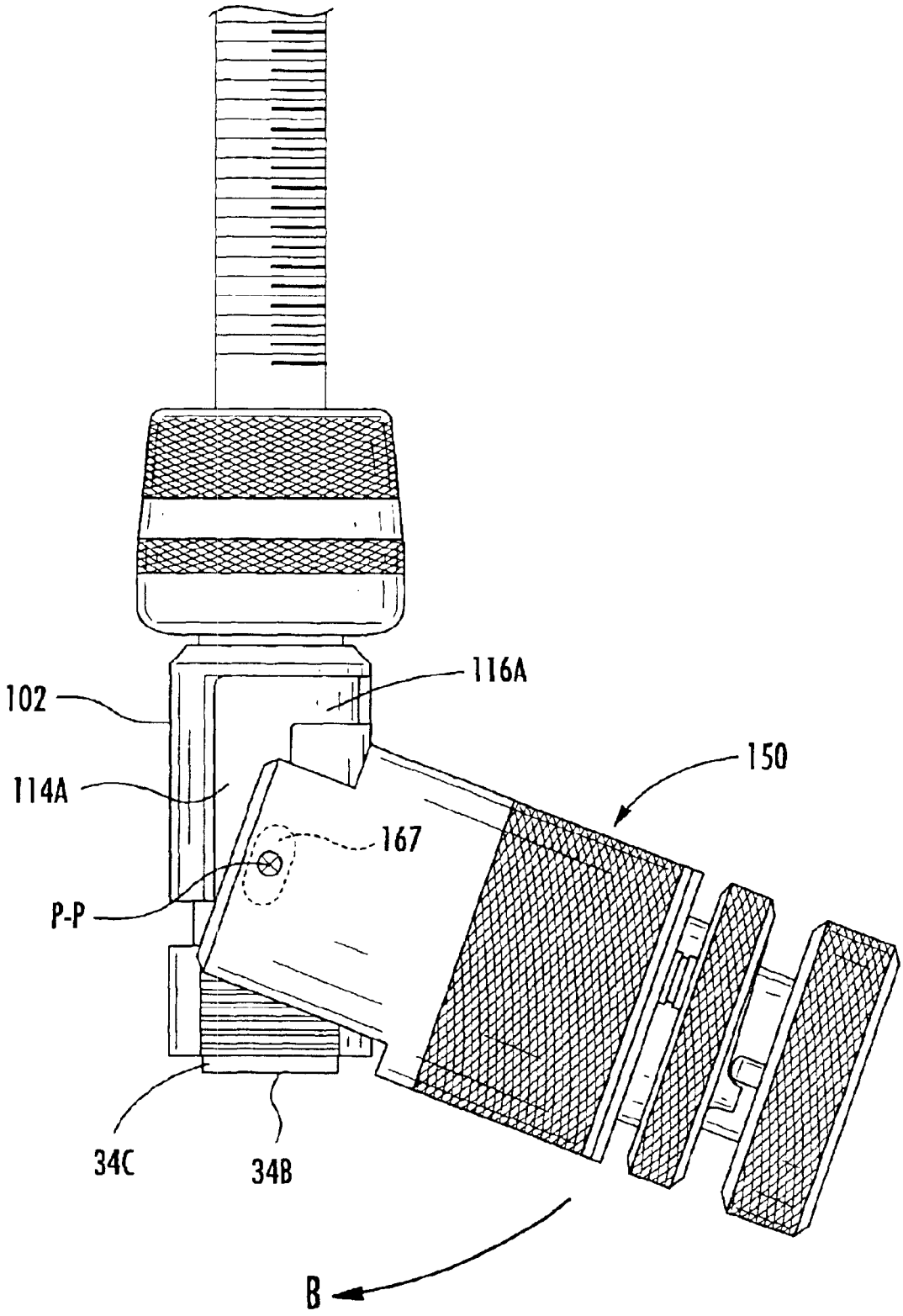
FIG. 7 is a side elevational view of the tool assembly of FIG. 1 wherein the drive assembly is in a further position.
Figure 8:
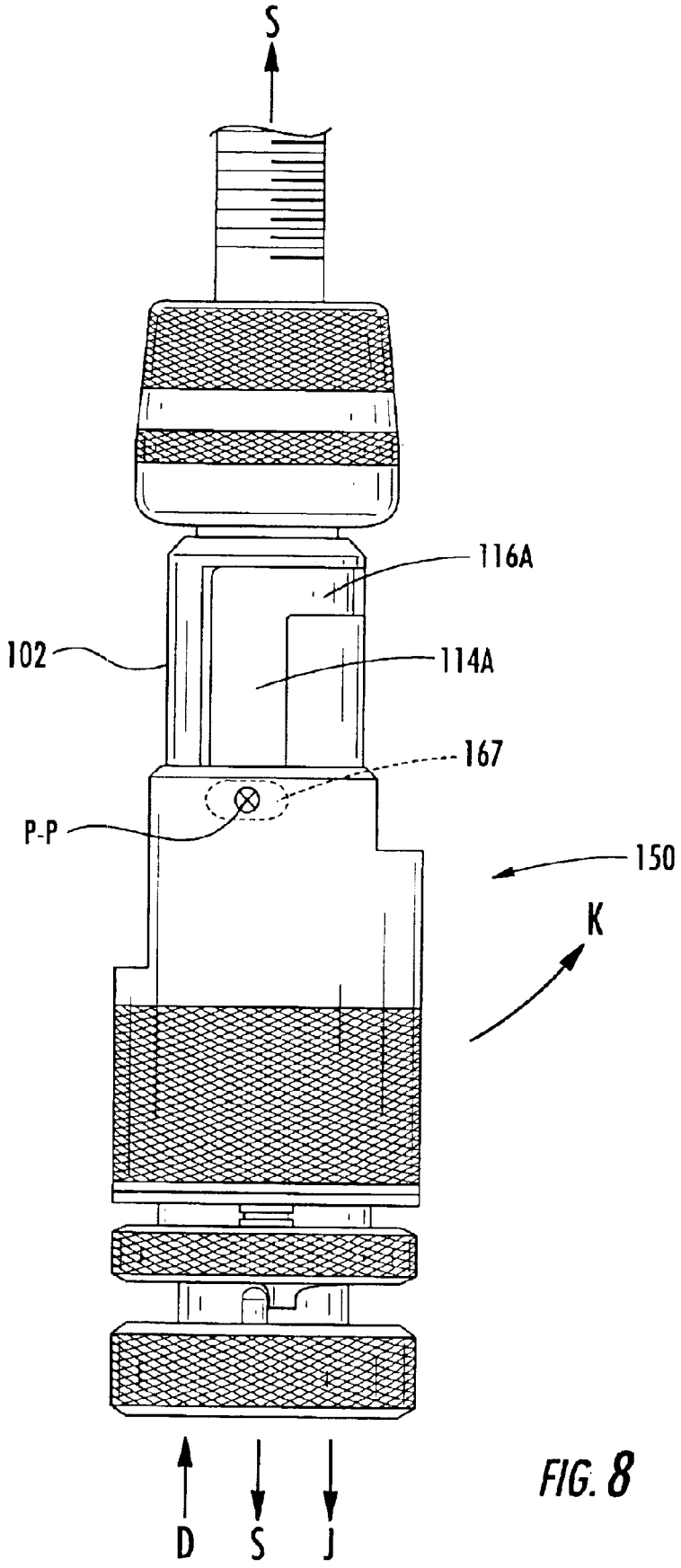
FIG. 8 is a side elevation view of the tool assembly of FIG. 1 wherein the drive assembly is in a further position.

With the cartridge 30 in place, the breech cap assembly 150 is lifted from the support recess 144 and slid downwardly parallel to a slide axis S—S a short distance to assume the position illustrated in FIG. 7. The breech cap assembly 150 is then pivoted about the tabs 167 about a pivot axis P—P in a direction B. The breech cap assembly 150 is pivoted into a position as shown in FIG. 8, wherein the breech cap assembly 150 is substantially coaxial with the breech 102. It will be appreciated that the pivoting path may not be restricted to pivoting about a single point, but may instead by somewhat accurate, for example.

Figure 9:
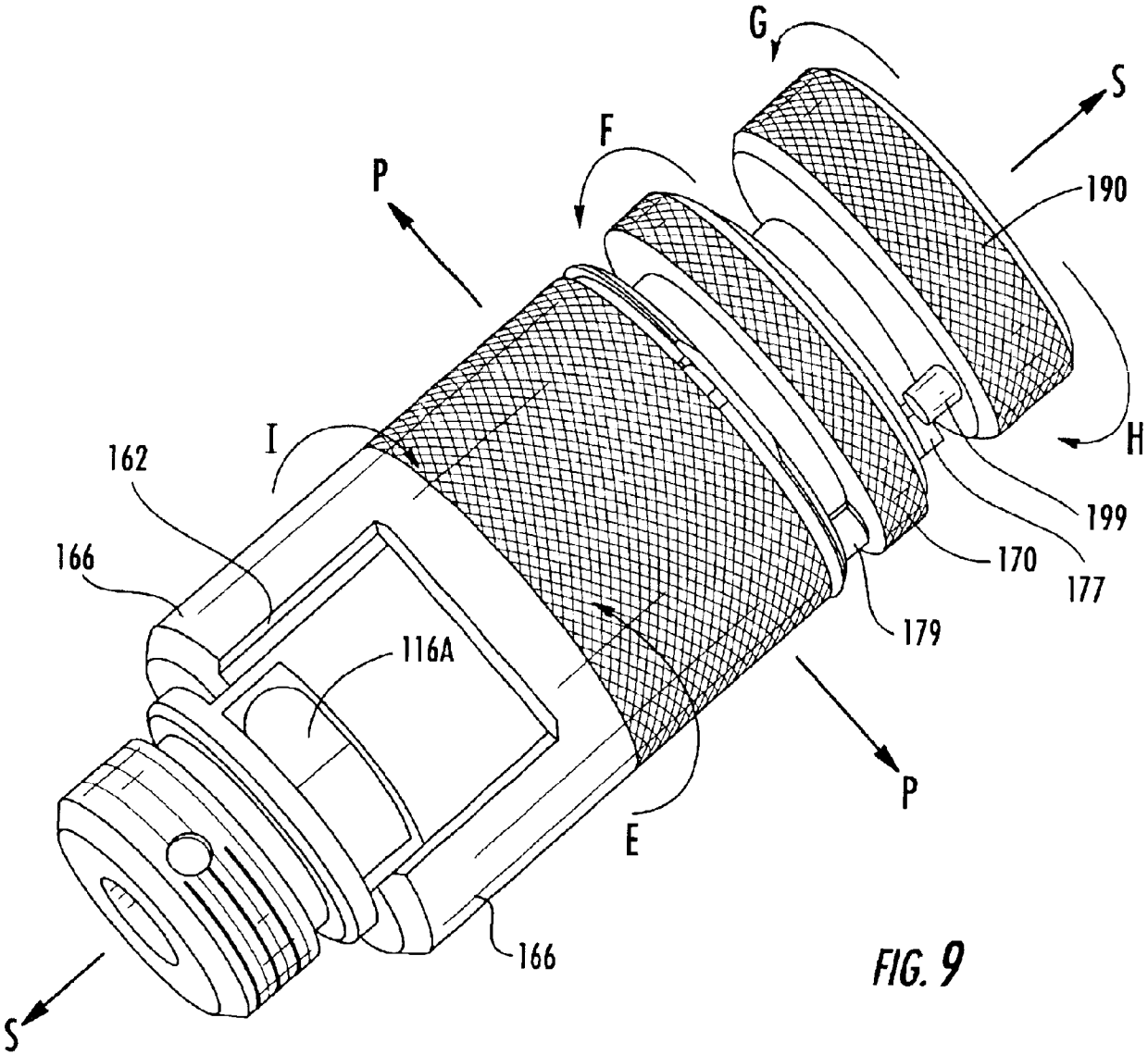
FIG. 9 is a further perspective view of the drive assembly of FIG. 2.

The breech cap sleeve 152 is then pushed forward on the breech 102 along the slide axis S—S in a direction D. The slide axis S—S is transverse (and, according to some preferred embodiments, perpendicular) to the pivot axis P—P. The tabs 167 slide within the axially extending channels 114A, 114B to thereby guide the breech cap sleeve 152 with respect to the breech 102. The breech cap sleeve 152 is slid onto the breech 102 until the breech cap assembly 150 reaches the position as shown in FIG. 9. This movement will serve to push the cartridge 30 fully into the breech 106 until the flange 34C abuts the flange 136 of the ejector sleeve 130 if the cartridge 30 is not already so positioned.

Figure 2:
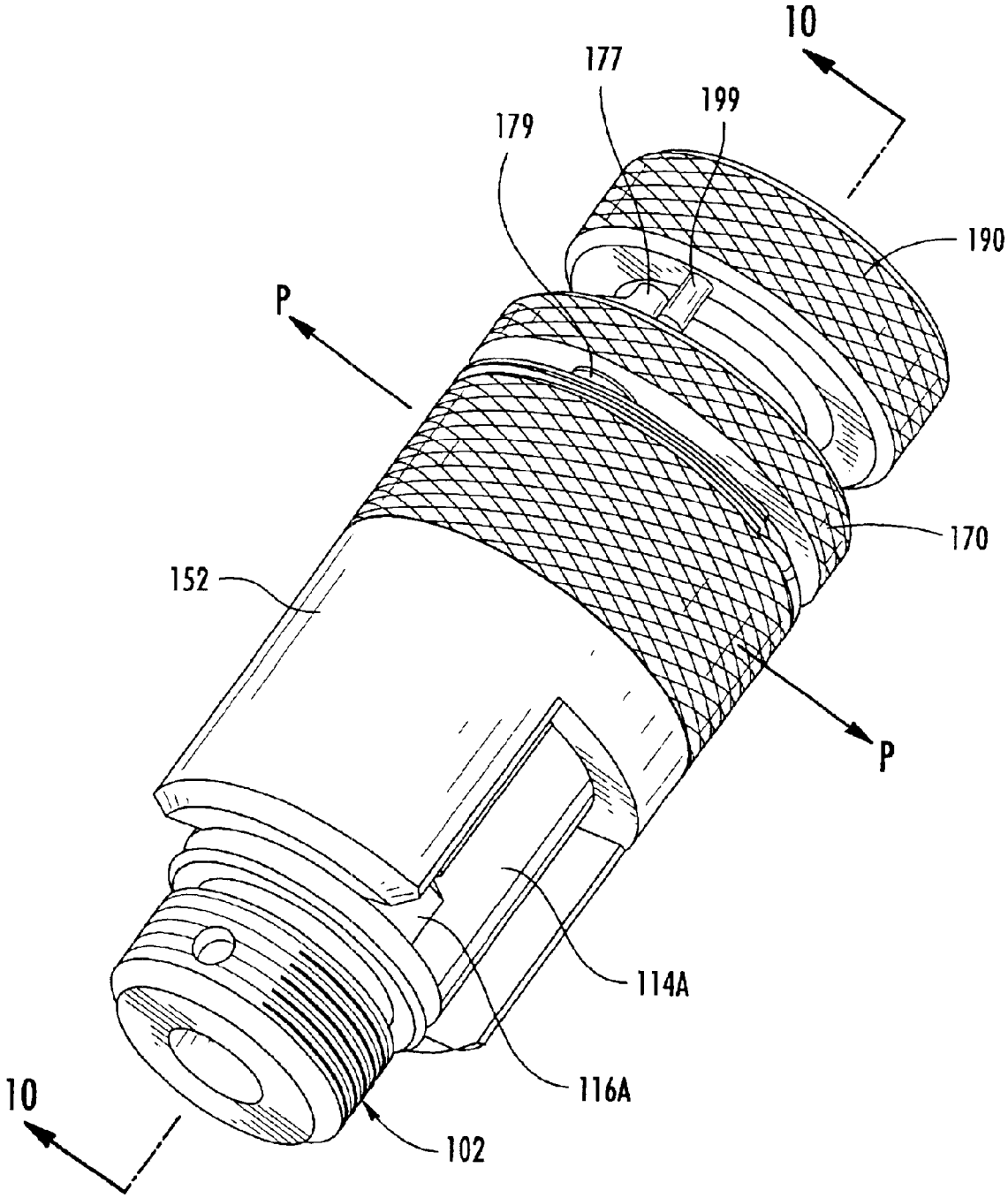
FIG. 2 is a perspective view of a drive assembly forming a part of the tool assembly of the FIG. 1.

The breech cap sleeve 152 is then rotated relative to the breech 102 about the slide axis S—S in a rotational direction E (FIG. 9). The tabs 167 slide within the circumferentially extending channels 116A, 116B to thereby guide the breech cap sleeve 152 with respect to the breech 102. The breech cap sleeve 152 is rotated in this manner on the breech 102 until the breech cap sleeve 152 reaches the position as shown in FIGS. 2 and 10. In this position, the tabs 167 and the circumferentially extending channels 116A, 116B cooperate to prevent relative movement between the breech cap sleeve 152 and the breech 102 along the axis S—S.

The pin guide housing 170 may then be rotated in a direction F (FIG. 9) about the axis SS to screw the pin guide housing 170 into the breech cap sleeve 152 and closer to the breech 102. The threads 178 slide within the cutout 179A of the lock pin 179 so that the lock pin 179 does not rotate but is driven forwardly through the slot 158 into the lock pin recess 142. The pin guide housing 170 is screwed into the breech cap sleeve 152 until the forward end of the pin guide housing 170 engages the ejector sleeve 130 and forces the ejector sleeve forwardly against the breech 102. The resulting position is shown in FIG. 11. In this position, the breech cap sleeve 152 is prevented from rotating relative to the breech 102 by the engagement between the lock pin 179 and the ejector sleeve 130. Additionally, according to some embodiments the cartridge 30 is driven forward by the housing 170 such that the prongs 39A are crushed by the ram 70.

Figure 12:
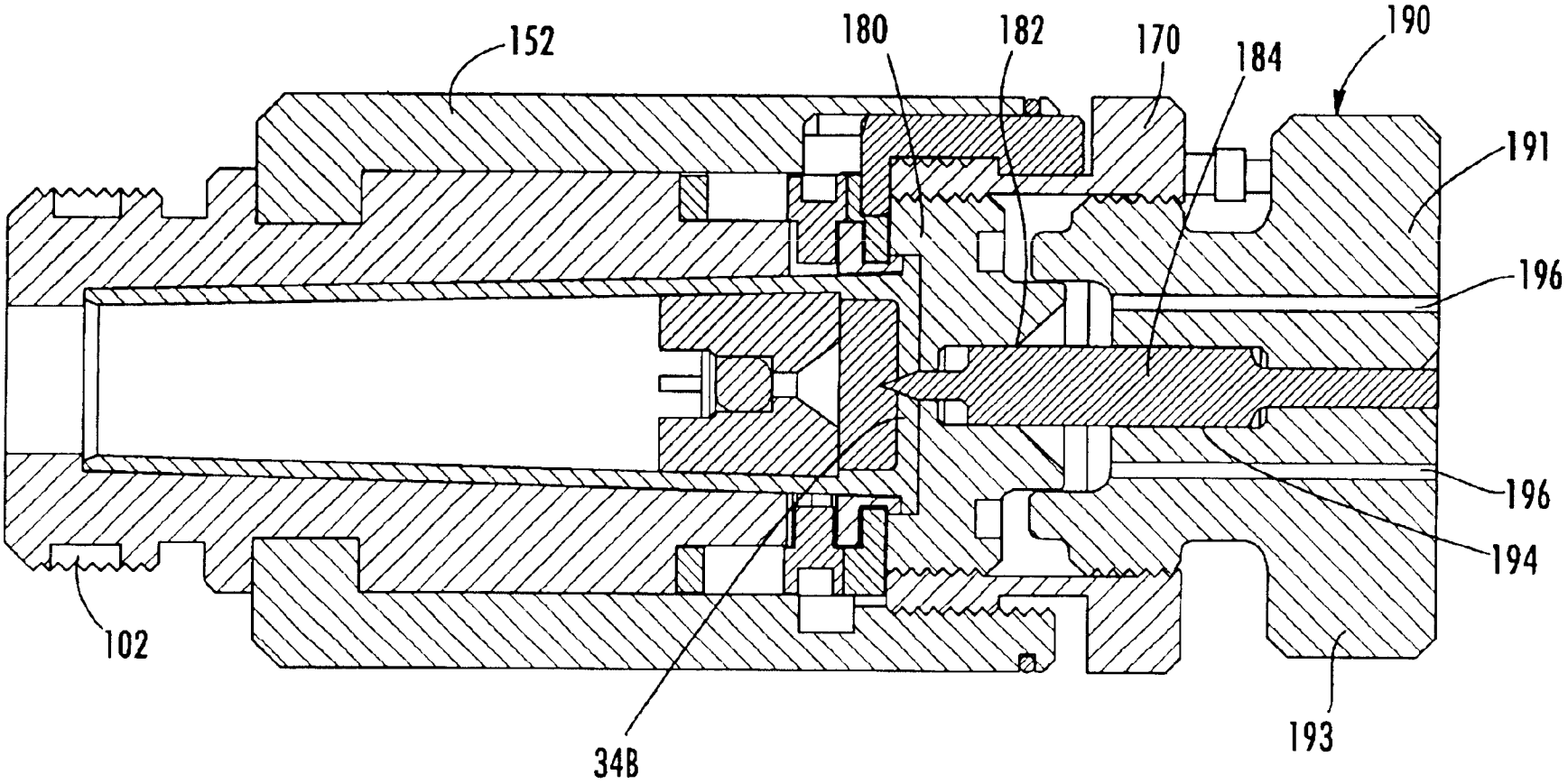
FIG. 12 is a cross-sectional view of the drive assembly of FIG. 2 taken along the same line as FIG. 10 and wherein the drive assembly in a further position.

The gas release knob 190 is then rotated in a direction G (FIG. 9) about the axis S—S to screw the gas release knob 190 into the pin guide housing 170 and closer to the breech 102 until the gas release knob 190 reaches a sealing position as shown in FIG. 12. In this manner, the piercer pin 184 is forced forwardly such that it pierces and the end wall 34B of the cartridge 30. The piercer pin 184 remains in the end wall 34B to seal the hole in the end wall 34B thus formed.

Using an alternative sequence, the housing 170 may not be screwed into the breech cap sleeve 152 as described above prior to rotating the gas release knob 190. Instead, the gas release knob 190 is first rotated in the direction G. The rotation of the gas release knob 190 will also rotate the housing 170 into the proper position after the gas release knob 190 has reached the proper position in relation to the housing 170. More particularly, at this time, the stop screw 199 will engage the tab 177, thereby causing the housing 170 to rotate with the gas release knob 190. The gas release knob 190 and the housing 170 will continue to turn together until the forward end of the housing 170 engages the ejector sleeve 130. With the lock pin 179 and the ejector sleeve 130 interlocked in this manner, the breech cap sleeve 152 cannot be rotated relative to the breech 102 about the slide axis S—S. This procedure for rotating the housing 170 and the knob 190 may be more convenient for execution by the operator.

The breech cap assembly 150 is now in the closed position as shown in FIGS. 2 and 12. In this position, the rear breech opening 108B is covered by the breech cap assembly 150 and thereby effectively sealed. The front end opening 108A is substantially sealed by the ram 70. The ram 70 is positioned such that its forward end is substantially flush with the forward opening of the coupling 50. According to some embodiments, the prongs 39A may be partially crushed by the rear end of the ram 70; however, the strike pin 76 is spaced apart from the primer 36. A small gap 78 (FIG. 10) is defined between the coupling 50 and the breech 102 in the coupling nut 60. The tool 45 is now prepared for firing.

Prior to or following loading of the cartridge 30 as described above, the coupling 50 of the tool assembly 40 is screwed into the coupling bore 86 of the tool-head 80 such that sufficient spacing between the front end of the coupling 50 and the abutment 86 remains for inserting the sleeve 7 and the wedge 9. The tool assembly 40 thus formed is then installed about the sleeve 7 and the wedge 9 as shown in FIG. 1 such that the components 7, 9 are received in the cradle 88. The coupling is screwed into the bore 86 until the sleeve 22 abuts the abutment 82 and the forward end of the coupling 50 abuts the wedge 24.

With the tool assembly 40 prepared and positioned as described above, the user next strikes the end wall 191 of the gas release knob 190. The gas release knob 190 may be struck using a hammer 15 (FIG. 1), for example. The strike force may be directed generally along the axis S—S. By striking in this manner, the user forces the coupling 50 against the wedge 24, which in turn slides the coupling 50 rearward in the coupling nut 60 to close the gap 78 (FIG. 10). The ram 70 is also thereby driven back into the cartridge 30 and the breech 102 such that the firing pin 76 is thereby driven into contact with the primer 36 to ignite the primer 36. The primer 36 in turn ignites the main charge 32. The explosion of the main charge 32 is contained by the closed breech 102 so that the ram 70 is driven forwardly by the explosion and forces the wedge 24 into the sleeve 22, thereby forming the connection 5.

The fired cartridge 30 can be removed and the tool 40 reloaded with a fresh cartridge using the following procedure. Typically, following the firing of the cartridge 30, a pressurized gas from the exploded charge 32 will remain in the breech chamber 106. Immediately removing the breech cap sleeve 152 from the breech 102 may cause the gas to be released in a manner potentially harmful to the user, bystanders, or the tool itself. Thus, it is desirable to first pre-release the gas in a controlled fashion. To accomplish this, the gas release knob 190 is rotated in a direction H (FIG. 9) about the axis S—S to unscrew the gas release knob 190 from the pin guide housing 170 to the gas release position as shown in FIG. 11. In this manner, the piercer pin 184 is pulled rearwardly such that it is withdrawn from the end wall 34B of the cartridge 30. The pressurized gas trapped in the breech chamber 106 and the cartridge 30 is allowed to escape through the hole in the end wall 34B, the bore 182 in the pin guide 180, and the gas release passage 196 in the gas release knob 190.

The user then continues to rotate the gas release knob 190 in the direction H such that the stop screw 199 engages the tab 177 and causes the pin guide housing 170 to rotate in the direction H with the gas release knob 190. The rotation of the housing 170 causes the housing 170 to translate rearwardly along the axis S—S, thereby withdrawing the locking pin 179 from the locking pin recess 142, and placing the drive assembly 100 in the position shown in FIG. 10. According to some embodiments, the stop screw 199 will engage and begin rotating the housing 170 after the gas release knob 190 has been rotated less than 360 degrees.

The breech cap sleeve 152 is thereafter rotated relative to the breech 102 in a direction I (FIG. 9) about the axis S—S to align the tabs 167 with the axially extending channels 114A, 114B, as shown in FIG. 9.

The breech cap sleeve 152 is then slid (e.g., pulled) relative to the breech 102 in a direction J (FIG. 8) along the axis S—S with the axially extending channels 114A, 114B serving to guide the breech cap sleeve 152. The breech cap sleeve 152 is slid such that the tabs 167 engage the ejector sleeve 130 and force the ejector sleeve 130 rearwardly relative to the breech 102. In this manner, the cartridge 30 may be dislodged from the breech 102. The user may grasp and pull the ejector sleeve 130 using the ribs 146 to facilitate removal of the cartridge.

The breech cap assembly 150 is next pivoted about the axis P—P in a direction K (FIG. 8). In this manner, the breech cap assembly 150 is returned to the open position as shown in FIG. 7. The breech cap assembly 150 may be further lifted to the supported position of FIG. 6. The spent cartridge 30 is now partially exposed and dislodged and can be easily removed and discarded. After the cartridge 30 has been removed, a new cartridge can be inserted into the drive assembly 100 and the tool 45 again prepared and fired in the manner described above.

The tool assembly 40 according to the present invention may provide a number of advantages. Because the drive assembly 100 is one integral or interconnected unit, it can be conveniently loaded and unloaded. In particular, it is not necessary to remove the breech cap assembly 150 or any portion thereof to access the breech chamber 102. Nonetheless, when the breech cap assembly 152 is in the open position, the breech opening 108B can be fully exposed to allow easy and effective insertion or removal of the cartridge. The drive assembly 100 may provide an effective, durable and reliable mechanism for safely releasing pressurized gas from the breech chamber 106 prior to opening the breech cap assembly 150. Moreover, according to some embodiments including those illustrated in the figures, the drive assembly 100 requires that the gas release knob 190 be axially withdrawn relative to the breech 102 in order to withdraw the locking pin 179 before the breech cap sleeve 152 can be rotated relative to the breech 102. This required sequence ensures that the piercer pin 184 will first be withdrawn from the cartridge, thereby ensuring that any pressurized gas will be released before the breech cap sleeve 152 is removed from its interlock with the circumferentially extending channels 116A, 116B.

While the drive assembly 100 includes the rotatable housing 170 and the separately rotatable gas release knob 190, in accordance with other embodiments of the invention the housing and the gas release knob may be integrally formed or assembled. However, the separately rotatable housing and gas release knob of the drive assembly 100 may provide enhanced safety and convenience. For example, the drive assembly 100 allows for release of pressurized gas by retracting the gas release knob 190 while still maintaining the breech cap sleeve 152 and the cartridge 30 in a secure arrangement by means of the housing 170.

As will be appreciated by those of skill in the art upon reading the description herein, the drive assembly 100 and other drive assemblies in accordance with the present invention may be used with explosive charge-actuated tools of other designs.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A tool for securing a connector on a conductor using an explosive charge, the tool comprising:

a) a first tool member;

b) a second tool member movably mounted on the first tool member;

c) a breech chamber defined in at least one of the first and second tool members, the breech chamber being adapted to receive the explosive charge;

d) a breech opening defined in at least one of the first and second tool members, the breech opening communicating with the breech chamber; and e) a drive member, wherein the tool is adapted to forcibly move the drive member responsive to an explosion of the explosive charge in the breech chamber;

f) wherein the second tool member is movable between a closed position, wherein the breech opening is closed, and an open position, wherein the breech opening is open to allow loading and unloading of the explosive charge into and from the breech chamber, by sliding the second tool member relative to the first tool member along a slide axis and additionally pivoting the second tool member relative to the first tool member about a pivot axis transverse to the slide axis.

2. The tool of claim 1 wherein the first tool member includes a tubular breech portion, the breech chamber and the breech opening being defined in the breech portion.

3. The tool of claim 2 wherein the second tool member includes a tubular breech cap sleeve, the breech cap sleeve being movable relative to and surrounding at least a portion of the breech portion.

4. The tool of claim 3 including:

a) a guide projection extending from the breech cap sleeve; and b) an axially extending guide channel defined in the breech portion;

c) wherein the axially extending guide channel and the guide projection are cooperatively configured to guide the breech cap sleeve as the breech cap sleeve is slid relative to the breech portion along the slide axis to move the second tool member between the open and closed positions.

5. The tool of claim 4 further including a circumferentially extending guide channel defined in the breech portion and intersecting the axially extending guide channel, wherein the circumferentially extending guide channel and the guide projection are cooperatively configured to secure the second tool member in the closed position.

6. The tool of claim 5 further including a lock pin selectively movable between a locked position, wherein the lock pin prevents relative rotation between the breech portion and the breech cap sleeve, and an unlocked position, wherein the lock pin permits relative rotation between the breech portion and the breech cap sleeve.

7. The tool of claim 6 wherein the second tool member includes a control member mounted on the breech cap sleeve, and the lock pin is movable between the locked and unlocked positions by rotating the control member relative to the breech cap sleeve.

8. The tool of claim 7 include a lock pin guide slot defined in the breech cap sleeve, wherein the lock pin is slidably received in the lock pin guide slot.

9. The tool of claim 4 including an ejector sleeve adapted to engage a cartridge containing the explosive charge, wherein the ejector sleeve is mounted on the first tool member such that, when the breech cap sleeve is slid relative to the breech portion along the slide axis to move the second tool member to the open position, the guide projection displaces the ejector sleeve relative to the breech chamber.

10. The tool of claim 3 including a gas release member coupled to the breech cap sleeve and rotatable relative to the breech cap sleeve between a sealing position and a gas release position.

11. The tool of claim 1 including a gas release mechanism operable to release pressurized gas from the breech chamber while the second tool member is in the closed position.

12. The tool of claim 11 wherein the gas release mechanism includes a gas release member movable between a sealing position and a gas release position.

13. The tool of claim 12 wherein the tool is configured such that the gas release member must be placed in the gas release position to enable movement of the second tool member from the closed position to the open position.

14. The tool of claim 12 wherein the gas release mechanism includes a piercer pin adapted to pierce a cartridge in the breech chamber when the gas release member is in the sealing position and to release pressurized gas from the cartridge when the gas release member is in the gas release position.

15. The tool of claim 1 wherein the first tool member includes a holding structure adapted to maintain the second tool member in the open position.

16. The tool of claim 1 wherein:

a) the first tool member includes a tubular breech portion, the breech chamber and the breech opening being defined in the breech portion;

b) the second tool member includes a tubular breech cap sleeve, the breech cap sleeve being movable relative to and surrounding at least a portion of the breech portion;

c) the tool includes:

a guide projection extending from the breech cap sleeve;

an axially extending guide channel defined in the breech portion, the axially extending guide channel and the guide projection being cooperatively configured to guide the breech cap sleeve as the breech cap sleeve is slid relative to the breech portion along the slide axis to move the second tool member between the open and closed positions;

a circumferentially extending guide channel defined in the breech portion and intersecting the axially extending guide channel, the circumferentially extending guide channel and the guide projection being cooperatively configured to secure the second tool member in the closed position;

a lock pin selectively movable between a locked position, wherein the lock pin prevents relative rotation between the breech portion and the breech cap sleeve, and an unlocked position, wherein the lock pin permits relative rotation between the breech portion and the breech cap sleeve a control member mounted on the breech cap sleeve, the lock pin being movable between the locked and unlocked positions by rotating the control member relative to the breech cap sleeve;

a gas release member mounted on the breech cap sleeve such that the gas release member is movable between a sealing position and a gas release position wherein pressurized gas may escape from the breech chamber while the second tool member is in the closed position.

17. The tool of claim 16 including an ejector sleeve adapted to engage a cartridge containing the explosive charge, wherein the ejector sleeve is mounted on the first tool member such that, when the breech cap sleeve is slid relative to the breech portion along the slide axis to move the second tool member to the open position, the guide projection displaces the ejector sleeve relative to the breech chamber.

18. The tool of claim 17 wherein the gas release mechanism includes a piercer pin adapted to pierce a cartridge in the breech chamber when the gas release member is in the sealing position and to release pressurized gas from the cartridge when the gas release member is in the gas release position.

19. The tool of claim 1 wherein the drive member is a ram.

20. The tool of claim 19 including an elongated coupling portion defining a barrel passage, wherein the ram extends through the barrel passage and into the breech chamber.

21. The tool of claim 20 wherein the tool is operable to explode an explosive charge in the breech chamber by striking a portion of the tool such that the ram is forcibly driven into the barrel passage toward the explosive charge, whereupon the explosive charge drives the ram through the barrel passage away from the explosive charge.

22. The tool of claim 1 including a tool head mounted on the first tool member and adapted to engage the connector.

23. The tool of claim 1 including a cartridge disposed in the breech chamber, the cartridge containing the explosive charge.

24. A method for using a tool for securing a connector on a conductor using an explosive charge, the tool including a first tool member, a second tool member movably mounted on the first tool member, a breech chamber defined in at least one of the first and second tool members, the breech chamber being adapted to receive the explosive charge, a breech opening defined in at least one of the first and second tool members, the breech opening communicating with the breech chamber, and a drive member, wherein the tool is adapted to forcibly move the drive member responsive to an explosion of the explosive charge in the breech chamber, the method comprising the steps of:

a) sliding the second tool member relative to the first tool member along a slide axis; and b) pivoting the second tool member relative to the first tool member about a pivot axis transverse to the slide axis;

such that the second tool member is moved from a closed position, wherein the breech opening is closed, to an open position, wherein the breech opening is open to allow loading and unloading of the explosive charge into and from the breech chamber.

25. The method of claim 24 further including the steps of:

a) sliding the second tool member relative to the first tool member along the slide axis; and b) pivoting the second tool member relative to the first tool member about the pivot axis transverse to the slide axis;

such that the second tool member is moved from the open position to the closed position to prepare the tool for exploding the explosive charge to forcibly move the drive member.

26. The method of claim 24 further including the step of rotating the second tool member relative to the first tool member about the slide axis.

27. The method of claim 26 including moving a lock pin from a locked position, wherein the lock pin prevents relative rotation between the breech portion and the breech cap sleeve, to an unlocked position, wherein the lock pin permits relative rotation between the breech portion and the breech cap sleeve.

28. The method of claim 27 including rotating a control member to move the lock pin from the locked position to the unlocked position.

29. The method of claim 27 wherein the step of moving the lock pin includes sliding the lock pin in a lock pin guide slot defined in the second tool member.

30. The method of claim 24 wherein the step of sliding the second tool member relative to the first tool member along the slide axis includes displacing an ejector sleeve relative to the breech chamber, wherein the ejector sleeve is adapted to engage a cartridge containing the explosive charge.

31. The method of claim 24 including the step of releasing pressurized gas from the breech chamber while the second tool member is in the closed position using a gas release mechanism.

32. The method of claim 31 wherein the step of releasing pressurized gas includes moving a gas release member mounted on the second tool member from a sealing position to a gas release position.

33. The method of claim 32 wherein the step of moving the gas release member from the sealing position to the gas release position includes withdrawing a piercer pin from a cartridge in the breech chamber to release pressurized gas from the cartridge.

34. The method of claim 24 including the step of maintaining the second tool member in the open position using a holding structure of the first tool member.

35. The method of claim 24 including the step of inserting the explosive charge into the breech chamber through the breech opening while the second tool member is in the open position.

36. The method of claim 35 wherein the step of inserting the explosive charge into the breech chamber includes inserting a cartridge containing the explosive cartridge into the breech chamber through the breech opening while the second tool member is in the open position.

37. The method of claim 36 including the steps of:

a) exploding the explosive charge in the breech chamber; and thereafter b) withdrawing the cartridge from the breech chamber through the breech opening.

38. The method of claim 24 wherein the first tool member includes a tubular breech portion, the breech chamber and the breech opening being defined in the breech portion, and the second tool member includes a tubular breech cap sleeve, the breech cap sleeve being movable relative to and surrounding at least a portion of the breech portion, and including the steps of:

a) moving a gas release member to release pressurized gas from the breech chamber; thereafter b) rotating the breech sleeve relative to the breech portion about the slide axis; thereafter c) sliding the breech sleeve relative to the breech portion along the slide axis; and thereafter d) pivoting the breech sleeve relative to the breech portion about the pivot axis.

39. The method of claim 38 including, prior to the step of rotating the breech sleeve relative to the breech portion about the slide axis, moving a lock pin from a locked position, wherein the lock pin prevents relative rotation between the breech portion and the breech cap sleeve, to an unlocked position, wherein the lock pin permits relative rotation between the breech portion and the breech cap sleeve.

40. The method of claim 24 including, following the step of pivoting the breech sleeve, the steps of:

a) inserting the explosive charge into the breech chamber through the breech opening; thereafter b) pivoting the breech sleeve relative to the breech portion about the pivot axis; thereafter c) sliding the breech sleeve relative to the breech portion along the slide axis; thereafter d) rotating the breech sleeve relative to the breech portion about the slide axis; and e) moving the gas release member into a sealing position to restrict the release of pressurized gas from the breech chamber.

41. The method of claim 40 including, following the step of rotating the breech sleeve relative to the breech portion about the slide axis, moving a lock pin from an unlocked position, wherein the lock pin permits relative rotation between the breech portion and the breech cap sleeve, to a locked position, wherein the lock pin prevents relative rotation between the breech portion and the breech cap sleeve.

42. The method of claim 24 wherein the drive member is a ram and including the step of exploding an explosive charge in the breech chamber by striking a portion of the tool such that the ram is forcibly driven into a barrel passage of the tool toward the explosive charge, whereupon the explosive charge drives the ram through the barrel passage away from the explosive charge.

43. The method of claim 24 including:

a) mounting a tool head on the first tool member and adapted to engage the connector; and b) engaging the tool head with a connector.

* * * * *